106-84 AU 113
11/22/83 OR 4,416,694

United States Patent [19]
Stevenson et al.

[11] 4,416,694
[45] Nov. 22, 1983

[54] SAND RECLAMATION

[75] Inventors: John Stevenson, Sutton Coldfield; John Machin, Lichfield; David L. Dyke, Birmingham, all of England

[73] Assignee: Foseco International Limited, England

[21] Appl. No.: 268,301

[22] Filed: May 29, 1981

[30] Foreign Application Priority Data

Jun. 5, 1980 [GB] United Kingdom ..... 8018423

[51] Int. Cl.[3] ..... C04B 19/04
[52] U.S. Cl. ..... 106/84; 106/38.35; 241/DIG. 10
[58] Field of Search ..... 106/38.35, 74, 84; 241/DIG. 10

[56] References Cited

U.S. PATENT DOCUMENTS

| | | | |
|---|---|---|---|
| 3,137,046 | 6/1964 | Barlow et al. | 106/38.35 |
| 3,542,299 | 11/1970 | Sholl | 241/DIG. 10 |
| 4,205,796 | 6/1980 | Evans | 241/DIG. 10 |
| 4,213,785 | 7/1980 | Blanc et al. | 106/84 |
| 4,233,076 | 11/1980 | Blanc et al. | 106/84 |

*Primary Examiner*—James Poer
*Attorney, Agent, or Firm*—Caesar, Rivise, Bernstein & Cohen, Ltd.

[57] ABSTRACT

A foundry sand composition which comprises particulate sand, aqueous sodium silicate as binder and an alkylene carbonate as hardener and which after use for moulds and/or cores in metal casting can be reclaimed for reuse by an attrition process contains before use no more than 11% by weight of alkylene carbonate based on the weight of aqueous sodium silicate and during the reclamation process has a residual moisture content of less than 0.8% by weight as determined by loss on ignition on 550° C.

5 Claims, No Drawings

SAND RECLAMATION

This invention relates to the reclamation of sand, for example silica sand, which is used to produce moulds and cores in foundries.

When used to make moulds and cores sand is mixed with one of a variety of binders such as bentonite clay, sodium silicate and a hardening agent for the sodium silicate or a resin. Due to the effect of exposure to metal casting temperatures and contact with molten metal the sand becomes contaminated with binder decomposition products, metallic particles and other debris. The sand must therefore be discarded and replaced by new sand or if the sand is to be reused it must first be treated to remove at least some of the contaminants.

If sand is to be reclaimed successfully the reclamation process must not only restore the condition of the sand by breaking down agglomerates and removing particles of metal flash but the process must also enable the sand to be reused with the same type of binding agent as before.

Various methods have been proposed for reclaiming used foundry sands for example processes involving wet scrubbing, calcination or attrition.

U.S. Pat. No. 1,700,713 describes an attrition process in which the used sand is subjected to a rubbing or abrasive action which loosens and removes adhering binder residues from the sand grains.

British Pat. No. 1,322,864 also describes an attrition process for reclaiming foundry sands suitable for use with sands bonded with irreversible inorganic and/or organic binders such as sodium silicate or furane resin.

However known attrition processes are not suitable for reclaiming foundry sands which contain sodium silicate as binder and a chemical hardening agent such as a polyhydric alcohol ester, for example triacetin or a carbonate ester, for example an alkylene carbonate.

In the case of such chemically hardened silicate bonded sands reclamation must remove not only a portion of the residues of the sodium silicate but also a portion of the hardening agent and its reaction products with the sodium silicate.

When reclaimed sand is reused it is first mixed with fresh sand and for a reclamation process to be both economically and technically successful it must be possible to use a high proportion of reclaimed sand in the reclaimed sand/fresh sand mixture.

Hitherto it has not been possible to reuse chemically hardened sodium silicate bonded sands at reuse levels of above about 50%, and with some processes even a 50% reuse level is not feasible.

Attempts to use reclaimed sand at higher reuse levels produces two particular problems. Firstly when the silicate binder and the hardener are added to the mixture of reclaimed and fresh sand the resulting sand composition does not remain workable long enough for satisfactory mould and/or core production to be achieved, and secondly those moulds and/cores which are produced do not achieve sufficient strength.

The present invention is concerned with sodium silicate-bonded sands hardened with alkylene carbonates such as propylene carbonate which can be reclaimed by an attrition process, and reused mixed with fresh sand at reuse levels which make the process economically and technically usable.

It has now been found that sand bonded with aqueous sodium silicate and hardened with an alkylene carbonate can be reclaimed to provide an acceptable reclaimed sand by means of an attrition process provided the sand is essentially moisture free and the quantity of alkylene carbonate present in relation to the quantity of aqueous sodium silicate does not exceed a certain value.

According to the invention there is provided a sand composition suitable for reclamation by an attrition process after use for the production of foundry moulds and/or cores so as to produce an acceptable reclaimed sand (as hereinafter defined), comprising sand, aqueous sodium silicate and an alkylene carbonate characterised in that before use the content of alkylene carbonate present does not exceed 11% by weight based on the weight of aqueous sodium silicate and that during reclamation the used sand composition contains no more than 0.8% by weight of residual moisture as determined by loss on ignition at 550° C.

According to a further feature of the invention there is provided a method of producing an acceptable reclaimed sand (as herein defined) from foundry moulds or cores which have been used to produce metal castings characterised in that used moulds or cores formed from a composition comprising particulate sand, aqueous sodium silicate and an alkylene carbonate in which the content of alkylene carbonate does not exceed 11% by weight based on the weight of aqueous sodium silicate are comminuted to particulate form and the resultant particles are subjected to an attrition process so as to remove contaminants therefrom and in that prior to or during the attrition process the particles are dried so that they contain no more than 0.8% by weight of residual moisture as determined by loss on ignition at 550° C.

Preferably the used sand composition contains no more than 0.5% by weight of residual moisture as determined by loss on ignition at 550° C.

For the purpose of the invention an acceptable reclaimed sand is defined as a reclaimed sand which can be subjected to at least a further 5 cycles consisting of (i) formation into moulds and/or cores bonded using a sodium silicate binder hardened by an alkylene carbonate, (ii) a reclamation process including the steps of crushed and attrition, and (iii) reuse by mixing at a preselected rate with unused sand, i.e. sand not previously used in a foundry mould or core, sodium silicate binder and alkylene carbonate, to produce at the end of each cycle a sand-binder-hardener mixture having a bench life of no less than 80% of the bench life of a similar mixture containing only unused sand, and which can be formed into a mould or core having an ultimate strength of no less than 85% of the ultimate strength of moulds and/or cores containing only unused sand.

The bench life of a foundry sand is the time throughout which the sand is workable, and the ultimate strength of a mould or core is the strength attained after the binder has been fully hardened which strength may conveniently be determined by measurement after 24 hours.

In quantitative terms "bench life" may be defined as the time in minutes required for a standard AFS 50 mm×50 mm cylindrical core to achieve a compression strength of 0.1 kg/cm$^2$, and "ultimate strength" may be defined as the strength in kg/cm$^2$ achieved by a standard AFS 50 mm×50 mm cylindrical core after 24 hours storage in an enclosed container.

The moisture content of used chemically hardened sodium silicate bonded sand is made up of several components, particularly:

(1) free water (2) water which is chemically bound within the binder film to varying degrees and
(3) volatile by-products arising from decomposition of the hardener during the hardening reaction.

Since some of the moisture components volatilise only slowly at relatively low temperatures the residual moisture of the used sand cannot be accurately determined at such temperatures because equilibrium cannot be achieved. It is therefore necessary to standardise on a relatively high temperature for determining moisture content and for the purpose of the invention a temperature of 550° C. has been chosen.

In order to ensure that the used sand contains no more than 0.8% by weight residual moisture as determined by loss on ignition at 550° C. the sand may be dried at some point in the reclamation process by any convenient method. For example after the comminution step the sand particles may be dried on trays in an oven in which hot air is circulated or by subjecting the particles to a stream of hot air in a fluidised bed. It may also be possible to dry the sand to the required degree during the attrition part of the reclamation process.

The drying step in the reclamation process may be carried out over a wide range of temperatures but is is preferably carried out at as low a temperature as is practicable, for example 100° C. or less, in order to conserve energy. If it is desired to maintain strip time as low as possible high drying temperatures should be avoided.

Strip time is the time after which a pattern may be removed from a mould or a core from a core box, and "strip time" may be defined as the time in minutes for a standard AFS 50 mm×50 mm cylindrical core to achieve a compression strength of 7.0 kg/cm$^2$.

Any type of equipment which reclaims sand by attrition may be used in the process of the invention. For example the sand particles may be entrained in a fast moving stream of air and projected at a target. The sand particles collide with each other and with the target and as a result of the rubbing action which takes place contaminants are removed.

Sands bonded with sodium silicate having a high soda content are more successfully reclaimed than those bonded with low soda content silicates. Low silica to soda ratio sodium silicates are therefore preferable to higher silica to soda ratio silicates since for a given sodium silicate content such binders have a higher soda content. In practice we have found sodium silicates having a silica to soda molar ratio of from 2.0:1 to 2.7:1 to be preferable for producing acceptable reclaimed sand, and a sand which has suitable properties in terms of bench life, hardening rate etc. Below a ratio of 2.0:1 sodium silicates can still be used but they produce sand compositions whose rate of strength development is too slow for most purposes, while sodium silicates having a ratio of more than 2.7:1 produce sands having too short a bench life.

Increasing the quantity of alkylene carbonate hardener present in relation to the sodium silicate makes successful reclamation more difficult so for a given quantity of sodium silicate binder as little hardener as possible should be used. Sand cannot be succesfully reclaimed if the quantity of hardener exceeds 11% by weight based on the weight of aqueous sodium silicate solution but providing this limitation is adhered to the actual quantities of aqueous sodium silicate and alkylene carbonate present may vary. However the proportion of alkylene carbonate hardener based on the weight of aqueous sodium silicate will not usually be less than 8% by weight because otherwise the hardening characteristics of the sand composition will not be satisfactory.

If desired the sodium silicate binder may also contain a proportion of another alkali metal silicate such as potassium silicate.

It may also be possible to include other ingredients but care must be taken to ensure that acceptable reclaimed sands can still be produced. It is fairly common to use sugar-containing sodium silicate solutions as foundry binders and some sugar-containing sodium silicates may be used to produce reclaimable sands according to the invention. However it is essential to test such binders before using them because many such binders, and particularly binders in which the silica to soda ratio of the sodium siliate exceeds about 2.0 to 1 are unsatisfactory.

The preferred alkylene carbonate is propylene carbonate although other alkylene carbonates, for example the isomers of butylene carbonate may be used. Mixtures of two or more alkylene carbonates may be used, particularly when it is desired to use an alkylene carbonate which is solid. In such cases, for example when using ethylene carbonate, it is convenient to dissolve the solid alkylene carbonate in a liquid alkylene carbonate such as propylene carbonate.

Reclaimed sand as herein defined is advantageous in that not only can the sand continually be reused but certain of the properties of a sand composition consisting of reclaimed sand and new sand may be better than those of a sand composition consisting of all new sand.

Surprisingly the ultimate strength of the hardened sand has been found to increase considerably, and the bench life of the sand can be almost doubled.

The invention is illustrated in the following examples in which Chelford 50 silica sand (A.F.S. Fineness No. 44) was used throughout.

The reclaimability of sand compositions was determined by the test procedure described below.

Sand which had been used to produce steel castings was reduced to grain size in a vibrator consisting of a series of vibrating grids of progressively reducing aperture size.

The comminuted sand was dried in an oven at 110° C. for one hour (unless otherwise stated), so as to reduce the residual moisture level of the sand to below 0.8% as determined by loss on ignition at 550° C.

The dried sand was subjected to attrition by entraining the comminuted sand in an air stream and propelling the sand against a metal target.

Fines (−200 mesh) were removed from the sand by treatment in a fluidised bed.

The reclaimed sand (70% by weight) was blended with dry new sand (30% by weight) and a portion of this sand mixture was mixed with fresh hardener and binder and its re-bonding characteristics determined. The bench life of a sand-binder-hardener mix was determined according to the definition given earlier i.e. the time required for a standard core to achieve a compression strength of 0.1 kg/cm$^2$. The remainder was also mixed with fresh hardener and binder and used to prepare a mould from which sand was recycled.

Sand was cycled five further times through this procedure or until the re-bonding characteristics failed to meet the requirements hereinbefore defined.

The re-bonding characteristics were determined as follows:

Hardener, followed by binder, was mixed with sand and the resultant sand-binder-hardener mixture was used to prepare standard 50 mm×50 mm cores. The compression strengths of the cores were determined.

(a) at intervals of time up to about 1 hour, stored in enclosed containers so as to prevent dehydration.

(b) after 24 hours in enclosed containers or exposed to air.

In the tables in the Examples the values alongside a particular cycle are values determined prior to the start of that cycle.

EXAMPLE 1

The reclaimability of sands bonded with 3.2% by weight of a sodium silicate solution ($SiO_2$:$Na_2O$ 2.0:1 viscosity 100 cp at 20° C.) and 0.32% by weight propylene carbonate were assessed as a function of drying temperature prior to mechanical attrition.

Four systems were compared as follows:

(1) Sand dried at 110° C. for 1 hour
(2) Sand dried at 200° C. for 1 hour
(3) Sand dried at 450° C. for 1 hour
(4) Sand dried at 800° C. for 1 hour.

The following data were obtained from the standard tests:

| | BENCH LIFE (min) | COMPRESSION STRENGTH (kg/cm²) TIME (min) 20 | 30 | 40 | 50 | 60 | 24 Hours with Dehydration | 24 Hours without Dehydration |
|---|---|---|---|---|---|---|---|---|
| SYSTEM 1 | | | | | | | | |
| CYCLE 1 | 10.0 | 2.2 | 4.3 | 5.3 | 6.2 | 7.5 | 32.7 | 21.9 |
| CYCLE 2 | 11.5 | 3.1 | 5.1 | 6.6 | 7.8 | 9.4 | 40.7 | 27.0 |
| CYCLE 3 | 10.0 | 5.0 | 10.4 | 12.9 | 14.7 | 16.3 | 46.4 | 25.4 |
| CYCLE 4 | 15.0 | 1.9 | 5.0 | 8.4 | 10.9 | 14.3 | 45.4 | 37.1 |
| CYCLE 5 | 13.0 | 1.0 | 7.6 | 12.5 | 15.2 | 16.5 | 46.9 | 30.6 |
| CYCLE 6 | 17.0 | 1.7 | 3.9 | 5.9 | 7.9 | 11.7 | 40.7 | 37.1 |
| SYSTEM 2 | | | | | | | | |
| CYCLE 1 | 10.0 | 2.2 | 4.3 | 5.3 | 6.2 | 7.5 | 32.7 | 21.9 |
| CYCLE 2 | 17.0 | 0.6 | 1.2 | 3.1 | 5.3 | 7.5 | 52.6 | 25.4 |
| CYCLE 3 | 17.0 | 0.8 | 2.7 | 4.6 | 6.4 | 7.7 | 46.4 | 24.0 |
| CYCLE 4 | 18.0 | 0.2 | 2.4 | 6.8 | 8.6 | 11.1 | 54.6 | 39.3 |
| CYCLE 5 | 15.0 | 0.7 | 3.6 | 8.2 | 12.4 | 14.0 | 51.1 | 30.0 |
| CYCLE 6 | 19.0 | 0.1 | 1.3 | 3.9 | 7.3 | 10.4 | 52.6 | 34.3 |
| SYSTEM 3 | | | | | | | | |
| CYCLE 1 | 10.0 | 2.2 | 4.3 | 5.3 | 6.2 | 7.5 | 32.7 | 21.9 |
| CYCLE 2 | 16.0 | 0.3 | 1.3 | 1.7 | 2.3 | 3.0 | 59.6 | 24.0 |
| CYCLE 3 | 14.0 | 0.6 | 1.5 | 2.4 | 3.5 | 4.0 | 38.7 | 17.3 |
| CYCLE 4 | 11.0 | 0.4 | 1.4 | 1.9 | 2.4 | 3.3 | 48.2 | 25.0 |
| CYCLE 5 | 14.0 | 0.5 | 1.3 | 2.2 | 2.8 | 3.4 | 50.1 | 24.0 |
| CYCLE 6 | 16.0 | 0.3 | 1.4 | 2.2 | 3.1 | 3.9 | 42.3 | 21.4 |
| SYSTEM 4 | | | | | | | | |
| CYCLE 1 | 10.0 | 2.2 | 4.3 | 5.3 | 6.2 | 7.5 | 32.7 | 21.9 |
| CYCLE 2 | 13.0 | 0.6 | 1.3 | 2.1 | 2.1 | 2.6 | 40.7 | 27.6 |

These results confirm that as far as producing an acceptable reclaimed sand is concerned the actual drying temperature is unimportant. However in order to conserve energy it is desirable to operate at a temperature of less than 200° C. Furthermore, as can be seen from the results, high drying temperatures can be disadvantageous in that they tend to lengthen stripping times.

EXAMPLE 2

The following systems were compared as 3.5% by weight additions of binder and 0.35% by weight additions of hardener:

(5) Sodium silicate; $SiO_2$:$Na_2O$ ratio 2.0:1, viscosity 100 cp at 20° C.—Propylene carbonate (6) Sodium silicate—as for (5)
Mixed acetate esters of glycerol The following results were obtained:

| | BENCH LIFE (min) | COMPRESSION STRENGTH (kg/cm²) TIME (min) 10 | 20 | 30 | 40 | 60 | 24 Hours with Dehydration | 24 Hours without Dehydration |
|---|---|---|---|---|---|---|---|---|
| SYSTEM 5 | | | | | | | | |
| CYCLE 1 | 9 | 0.1 | 7.1 | 11.4 | 15.6 | 19.2 | 29.4 | 22.6 |
| CYCLE 2 | 11 | — | 4.1 | 9.2 | 11.5 | 16.4 | 35.1 | 24.8 |
| CYCLE 3 | 12 | — | 4.0 | 9.0 | 10.4 | 14.2 | 40.4 | 32.1 |
| CYCLE 4 | 12 | — | 3.5 | 7.5 | 9.8 | 11.2 | 40.2 | 34.3 |
| CYCLE 5 | 14 | — | 3.0 | 7.0 | 9.5 | 11.1 | 35.1 | 32.6 |
| CYCLE 6 | 17 | — | 1.0 | 4.4 | 7.2 | 9.1 | 36.7 | 34.7 |
| SYSTEM 6 | | | | | | | | |
| CYCLE 1 | 9 | 0.1 | 4.6 | 8.2 | 11.2 | 14.3 | 31.7 | 22.4 |
| CYCLE 2 | 10 | 0.1 | 3.0 | 5.1 | 7.3 | 9.6 | 28.2 | 17.1 |
| CYCLE 3 | 6 | 2.0 | 4.1 | 5.3 | 5.8 | 6.1 | 21.2 | 14.6 |
| CYCLE 4 | 2 | | | | NOT DETERMINED | | | |

From the above data it is apparent that system (5) is reclaimable according to the definition given previously. Furthermore, according to the same definition, system (6) is not reclaimable in that (i) the bench life diminishes very rapidly until the sand has no bench life on the 5th cycle
(ii) final strengths in many cases decrease by greater than the acceptable level.

EXAMPLE 3

The reclaimability of the following systems was compared (all percentages by weight)

(7) 4.0% Sodium silicate—$SiO_2$:$Na_2O$ ratio 2.0:1, viscosity 100 cp at 20° C.
0.4% Propylene carbonate
(8) 3.5% Sodium silicate—as for (7)
0.35% Propylene carbonate
(9) 3.0% Sodium silicate—as for (7)
0.3% Propylene carbonate.

Thus in each case the hardener addition level represented 10% with respect to the binder.

The following data were obtained:

| | BENCH LIFE (min) | COMPRESSION STRENGTH (kg/cm²) TIME (min) 20 | 30 | 40 | 50 | 60 | 24 Hours with Dehydration | 24 Hours without Dehydration |
|---|---|---|---|---|---|---|---|---|
| SYSTEM 7 | | | | | | | | |
| CYCLE 1 | 12 | 2.0 | 3.1 | 5.0 | 6.7 | 8.1 | 42.3 | 14.9 |
| CYCLE 2 | 15 | 0.8 | 3.3 | 5.2 | 7.5 | 9.6 | 45.9 | 26.4 |
| CYCLE 3 | 15 | 0.9 | 2.9 | 6.4 | 7.6 | 9.6 | 46.4 | 31.0 |
| CYCLE 4 | 13 | 2.1 | 5.0 | 8.1 | 9.4 | 12.7 | 42.8 | 32.7 |
| CYCLE 5 | 11 | 5.1 | 10.0 | 15.1 | 19.6 | 22.8 | 44.8 | 37.1 |
| CYCLE 6 | 13 | 1.9 | 6.1 | 11.7 | 13.5 | 15.3 | 42.9 | 33.1 |
| SYSTEM 8 | | | | | | | | |
| CYCLE 1 | 11 | 2.0 | 3.1 | 3.6 | 5.0 | 7.0 | 31.6 | 21.4 |
| CYCLE 2 | 15 | 0.7 | 2.3 | 4.7 | 7.0 | 8.7 | 53.6 | 24.0 |
| CYCLE 3 | 15 | 1.6 | 5.9 | 8.4 | 11.2 | 11.7 | 51.1 | 36.6 |
| CYCLE 4 | 13 | 1.6 | 3.9 | 7.1 | 8.4 | 9.9 | 34.6 | 27.0 |
| CYCLE 5 | 13 | 1.7 | 3.9 | 5.1 | 6.4 | 8.5 | 39.7 | 22.4 |
| CYCLE 6 | 18 | 0.9 | 1.9 | 4.9 | 7.5 | 9.9 | 53.4 | 24.0 |
| SYSTEM 9 | | | | | | | | |
| CYCLE 1 | 10 | 1.0 | 2.1 | 3.3 | 4.3 | 6.4 | 32.7 | 10.7 |
| CYCLE 2 | 14 | 1.0 | 1.9 | 3.8 | 5.5 | 7.6 | 48.4 | 19.3 |
| CYCLE 3 | 16 | 1.4 | 3.4 | 5.6 | 7.6 | 9.4 | 45.9 | 28.6 |
| CYCLE 4 | 12 | 1.9 | 3.8 | 6.6 | 9.8 | 11.7 | 34.4 | 26.4 |
| CYCLE 5 | 13 | 1.7 | 3.4 | 4.7 | 5.9 | 7.9 | 38.1 | 20.3 |
| CYCLE 6 | 14 | 1.0 | 4.0 | 4.9 | 5.9 | 7.4 | 37.6 | 25.4 |

The above data indicate that the three systems tested are all reclaimable according to the definition given previously. The reclaimability was found to be unaffected by binder addition level between 3.0% and 4.0% using a hardener addition level of 10% with respect to the binder.

EXAMPLE 4

The reclaimability of sands bonded using the following binder-hardener systems was assessed in order to determine the effects of varying the proportion of hardener with respect to binder, all percentages are by weight:

(10) 3.5% Sodium silicate—$SiO_2$:$Na_2O$ 2.0:1, viscosity 100 cp at 20° C.
0.35% Propylene carbonate
(11) 3.5% Sodium silicate—as for (10)
0.42% Propylene carbonate
(12) 3.5% Sodium silicate—as for (10)
0.53% Propylene carbonate
(13) 3.5% Sodium silicate—as for (10)
0.63% Propylene carbonate.

The re-bonding characteristics of systems (10)–(13) were determined by the procedure described and the following data obtained:

| | BENCH LIFE (min) | COMPRESSION STRENGTH (kg/cm²) TIME (min) 20 | 30 | 40 | 50 | 60 | 24 Hours with Dehydration | 24 Hours without Dehydration |
|---|---|---|---|---|---|---|---|---|
| SYSTEM 10 | | | | | | | | |
| CYCLE 1 | 11 | 1.9 | 3.4 | 4.6 | 6.6 | 8.1 | 40.8 | 22.9 |
| CYCLE 2 | 14 | 0.8 | 3.8 | 6.9 | 8.3 | 10.5 | 46.9 | 24.4 |
| CYCLE 3 | 11 | 4.5 | 11.4 | 17.6 | 22.4 | 22.4 | 34.7 | 31.6 |
| CYCLE 4 | 10 | 3.6 | 9.1 | 12.3 | 14.0 | 19.3 | 45.8 | 43.4 |
| CYCLE 5 | 13 | 1.7 | 5.1 | 9.8 | 13.8 | 15.9 | 52.1 | 27.6 |
| CYCLE 6 | 17 | 0.2 | 2.7 | 5.9 | 8.9 | 8.9 | 37.1 | 25.9 |
| SYSTEM 11 | | | | | | | | |
| CYCLE 1 | 10 | 1.8 | 4.4 | 6.6 | 7.4 | 8.1 | 42.3 | 28.0 |
| CYCLE 2 | 14 | 1.1 | 4.1 | 8.1 | 11.3 | 12.4 | 43.4 | 33.6 |
| CYCLE 3 | 7 | 7.9 | 15.0 | 23.0 | — | — | 30.6 | 20.9 |
| CYCLE 4 | 0 | — | — | — | — | — | — | — |
| SYSTEM 12 | | | | | | | | |
| CYCLE 1 | 10 | 3.9 | 8.9 | 9.6 | 11.1 | 15.1 | 34.1 | 19.1 |
| CYCLE 2 | 13 | 0.9 | 4.9 | 5.7 | 12.9 | 16.8 | 48.0 | 29.6 |
| CYCLE 3 | 9 | 5.6 | 10.7 | 16.4 | 22.6 | 25.1 | 16.5 | 15.1 |
| CYCLE 4 | 0 | — | — | — | — | — | — | — |
| SYSTEM 13 | | | | | | | | |
| CYCLE 1 | 10 | 4.8 | 12.3 | 14.7 | 16.3 | 16.3 | 27.0 | 16.3 |

-continued

| | BENCH LIFE (min) | COMPRESSION STRENGTH (kg/cm²) TIME (min) 20 | 30 | 40 | 50 | 60 | 24 Hours with Dehydration | 24 Hours without Dehydration |
|---|---|---|---|---|---|---|---|---|
| CYCLE 2 | 11 | 3.1 | 6.3 | 9.6 | 12.0 | 18.5 | 41.2 | 29.0 |
| CYCLE 3 | 5 | 8.1 | 14.3 | 15.9 | 17.1 | 18.2 | 25.4 | 19.0 |
| CYCLE 4 | 0 | — | — | — | — | — | — | — |

The data in the above example illustrate that the use of 10% hardener with respect to binder (i.e. System 10) provides a reclaimable sand system according to the definition hereinbefore stated.

The use of hardener addition levels of 12% or more with respect to binder (i.e. Systems 11–13) provides a recycled sand which eventually is rendered unusable due to the absence of any bench life.

EXAMPLE 5

The reclaimability of sands bonded with sodium silicates of $SiO_2$:$Na_2O$ ratios greater than 2.0:1 and up to 2.7:1 were assessed as 3.5% by weight additions to sand together with 0.35% by weight additions of propylene carbonate as hardener.

The following systems were evaluated:

(14) Sodium silicate, $SiO_2$:$Na_2O$ ratio 2.2:1, viscosity 100 cp at 20° C.

(15) Sodium silicate, $SiO_2$:$Na_2O$ ratio 2.4:1, viscosity 100 cp at 20° C.

(16) Sodium silicate $SiO_2$:$Na_2O$ ratio 2.7:1, viscosity 100 cp at 20° C.

The data obtained were as follows:

| | BENCH LIFE (min) | COMPRESSION STRENGTH (kg/cm²) TIME (min) | | | | 24 Hours with Dehydration | 24 Hours without Dehydration |
|---|---|---|---|---|---|---|---|
| SYSTEM 14 | | 20 | 30 | 40 | 50 | | |
| CYCLE 1 | 8 | 6.4 | 10.5 | 12.8 | 14.6 | 34.6 | 25.4 |
| CYCLE 2 | 11 | 4.6 | 7.7 | 11.5 | 15.0 | 39.7 | 26.4 |
| CYCLE 3 | 14 | 2.0 | 4.4 | 9.6 | 13.6 | 55.1 | 22.9 |
| CYCLE 4 | 14 | 2.0 | 4.3 | 9.4 | 12.9 | 45.4 | 25.4 |
| CYCLE 5 | 14 | 2.0 | 4.3 | 9.6 | 13.5 | 48.0 | 29.6 |
| CYCLE 6 | 15 | 2.0 | 3.8 | 6.2 | 10.7 | 39.7 | 25.0 |
| SYSTEM 15 | | | | | | | |
| CYCLE 1 | 8 | 7.9 | 14.0 | 17.9 | 19.6 | 39.3 | 28.0 |
| CYCLE 2 | 14 | 0.2 | 2.1 | 6.6 | 10.5 | 72.5 | 28.6 |
| CYCLE 3 | 15 | 0.2 | 2.3 | 6.9 | 10.8 | 62.7 | 39.3 |
| CYCLE 4 | 15 | 0.3 | 3.4 | 8.0 | 11.0 | 59.1 | 30.6 |
| CYCLE 5 | 15 | 0.5 | 3.1 | 5.4 | 13.1 | 57.7 | 34.6 |
| CYCLE 6 | 17 | 2.1 | 3.2 | 6.2 | 10.7 | 47.4 | 31.0 |
| SYSTEM 16 | | 10 | 20 | 30 | 40 | | |
| CYCLE 1 | 6 | 4.0 | 12.2 | 19.3 | — | 26.6 | 17.9 |
| CYCLE 2 | 6 | 0.8 | 4.7 | 10.2 | 12.1 | 37.1 | 27.0 |
| CYCLE 3 | 8 | 0.2 | 1.8 | 5.8 | 9.4 | 37.6 | 24.0 |
| CYCLE 4 | 5 | 0.6 | 2.1 | 6.6 | 8.5 | 49.4 | 26.4 |
| CYCLE 5 | 9 | 0.1 | 1.4 | 4.1 | 8.1 | 41.9 | 22.4 |
| CYCLE 6 | 7 | 0.3 | 2.5 | 6.5 | 10.4 | 40.7 | 24.0 |

The above data confirm that reclaimable sand systems are obtainable using sodium silicate binders of ratios higher than 2.0 and at least as high as 2.7.

EXAMPLE 6

The following binder systems were prepared:

(17) 10% by weight of sucrose was dissolved in 90% by weight of the sodium silicate solution of system (10)

(18) 10% by weight of sucrose was dissolved in 90% by weight of the sodium silicate solution of system (14)

(19) 10% by weight of sucrose was dissolved in 90% by weight of the sodium silicate solution of system (15)

(20) 10% by weight of sucrose was dissolved in 90% by weight of the sodium silicate solution of system (16).

The reclaimability of systems (17)–(19) was assessed as 3.5% by weight additions to sand in conjunction with 0.35% by weight additions of propylene carbonate as hardener. The following data were obtained:

| | BENCH LIFE (min) | COMPRESSION STRENGTH (kg/cm²) TIME (min) 20 | 30 | 40 | 50 | 24 Hours with Dehydration | 24 Hours without Dehydration |
|---|---|---|---|---|---|---|---|
| SYSTEM 17 | | | | | | | |
| CYCLE 1 | 11 | 2.1 | 4.3 | 6.1 | 7.6 | 36.2 | 15.5 |
| CYCLE 2 | 15 | 0.8 | 3.0 | 4.9 | 5.1 | 36.1 | 17.2 |
| CYCLE 3 | 15 | 0.8 | 2.6 | 5.0 | 5.3 | 51.6 | 16.9 |
| CYCLE 4 | 16 | 0.6 | 2.4 | 5.0 | 7.2 | 38.9 | 19.5 |
| CYCLE 5 | 16 | 0.6 | 2.5 | 5.0 | 5.3 | 38.0 | 16.9 |

-continued

| | BENCH LIFE (min) | COMPRESSION STRENGTH (kg/cm²) TIME (min) 20 | 30 | 40 | 50 | 24 Hours with Dehydration | 24 Hours without Dehydration |
|---|---|---|---|---|---|---|---|
| CYCLE 6 | 19 | 0.1 | 0.8 | 3.1 | 4.6 | 51.6 | 37.0 |
| SYSTEM 18 | | | | | | | |
| CYCLE 1 | 9 | 7.7 | 15.8 | 16.1 | 16.9 | 44.8 | 22.1 |
| CYCLE 2 | 16 | 0.5 | 2.2 | 5.5 | 8.9 | 56.1 | 22.4 |
| CYCLE 3 | 16 | 0.5 | 3.0 | 5.6 | 9.1 | 52.1 | 22.6 |
| CYCLE 4 | 14 | 1.4 | 3.8 | 6.3 | 7.7 | 59.6 | 24.6 |
| CYCLE 5 | 16 | 0.4 | 2.1 | 4.4 | 6.8 | 41.9 | 24.6 |
| CYCLE 6 | 18 | 0.2 | 1.9 | 5.4 | 8.1 | 43.9 | 18.0 |
| SYSTEM 19 | | | | | | | |
| CYCLE 1 | 7 | 11.9 | 15.7 | 18.0 | 18.6 | 41.9 | 23.1 |
| CYCLE 2 | 11 | 1.4 | 3.7 | 6.3 | 8.9 | 51.1 | 20.5 |
| CYCLE 3 | 15 | 0.4 | 1.3 | 3.0 | 5.2 | 56.6 | 16.9 |
| CYCLE 4 | 16 | 0.3 | 0.9 | 2.6 | 4.5 | 52.1 | 16.5 |
| CYCLE 5 | 14 | 0.7 | 2.4 | 5.4 | 8.2 | 51.1 | 18.4 |
| CYCLE 6 | 14 | 0.6 | 1.5 | 3.0 | 5.0 | 48.4 | 19.2 |
| SYSTEM 20 | | | | | | | |
| CYCLE 1 | 6 | 10.9 | 15.7 | 18.6 | — | 22.1 | 20.1 |
| CYCLE 2 | 7 | 4.9 | 8.6 | 13.9 | — | 42.9 | 19.4 |
| CYCLE 3 | 9 | 1.1 | 4.6 | 8.8 | 12.4 | 37.1 | 16.6 |
| CYCLE 4 | 5 | 5.0 | 9.6 | 11.0 | — | 41.9 | 15.5 |
| CYCLE 5 | 5 | 2.1 | 3.6 | 7.2 | — | 46.9 | 12.4 |
| CYCLE 6 | 5 | 2.6 | 7.1 | 9.4 | — | 51.1 | 14.3 |

As can be seen from the table the presence of the sucrose in the sodium silicate binder has a deleterious effect on the properties of the reclaimed sand, the ultimate strength measured in the absence of dehydration deteriorating as the silica to soda ratio of the sodium silicate increases until the ultimate strength of cores produced from the sand-binder composition is outside the definition of an acceptable reclaimed sand.

EXAMPLE 7

The reclaimability of sands bonded using the following binder-hardener system was assessed in order to determine the effect of using a hardener whose composition consisted of a mixture containing equal amounts by weight of propylene carbonate and ethylene carbonate.

(21) 3.5% by weight Sodium silicate—$SiO_2$:$Na_2O$ ratio 2.0:1, viscosity 100 cp at 20° C., 0.35% by weight Propylene Carbonate:Ethylene Carbonate (1:1).

The re-bonding characteristics of system (20) were determined by the procedure described and the following data obtained:

The data in the above example illustrate that the use of 10% of hardener, having a composition of equal weights of propylene carbonate and ethylene carbonate, with respect to binder provides a reclaimable sand system according to the invention.

EXAMPLE 8

The following example demonstrates the importance of the drying step in the reclamation process.

The reclaimability of sands bonded using the following binder-hardener systems was assessed in order to determine the effect of drying on the reclaimability, all percentages are by weight.

(22) 3.5% Sodium silicate—$SiO_2$:$Na_2O$ ratio 2.2:1, viscosity 100 cp at 20° C., 0.35% by weight Propylene Carbonate.

The used sand was dried during the reclamation process to a moisture content of 0.5% by weight as determined by loss on ignition at 550° C.

(23) 3.5% Sodium silicate—$SiO_2$:$Na_2O$ ratio 2.2:1, viscosity 100 cp at 20° C., 0.35% by weight Propylene Carbonate.

The used sand had a residual moisture content of 1.32% by weight as determined by loss on ignition at 550° C.

| | BENCH LIFE (min) | COMPRESSION STRENGTH (kg/cm²) TIME (min) 20 | 30 | 40 | 50 | 60 | 24 Hours with Dehydration | 24 Hours without Dehydration |
|---|---|---|---|---|---|---|---|---|
| SYSTEM 21 | | | | | | | | |
| CYCLE 1 | 7 | 2.8 | 5.8 | 7.5 | 8.1 | 8.4 | 30.8 | 13.8 |
| CYCLE 2 | 11 | 2.1 | 4.8 | 6.4 | 7.7 | 8.6 | 29.5 | 16.3 |
| CYCLE 3 | 12 | 2.6 | 3.9 | 6.3 | 8.8 | 10.6 | 40.3 | 18.3 |
| CYCLE 4 | 12 | 2.8 | 5.6 | 8.5 | 9.4 | 10.1 | 29.0 | 20.1 |
| CYCLE 5 | 11 | 4.3 | 8.0 | 10.1 | 11.2 | 12.4 | 39.0 | 27.0 |
| CYCLE 6 | 11 | 4.1 | 8.0 | 11.8 | 13.8 | 15.1 | 30.6 | 19.3 |

| | BENCH LIFE (min) | COMPRESSION STRENGTH (kg/cm²) TIME (min) 20 | 40 | 60 | 80 | 100 | 24 Hours with Dehydration | 24 Hours without Dehydration |
|---|---|---|---|---|---|---|---|---|
| SYSTEM 22 | | | | | | | | |
| CYCLE 1 | 8 | 9.2 | 14.1 | 21.7 | 22.1 | 22.9 | 27.6 | 23.0 |
| CYCLE 2 | 18 | — | 7.0 | 10.5 | 11.9 | 12.4 | 28.0 | 24.6 |
| CYCLE 3 | 22 | — | 6.5 | 12.1 | 13.1 | 15.0 | 40.4 | 27.0 |
| CYCLE 4 | 22 | — | 12.1 | 15.4 | 17.6 | 19.1 | 51.6 | 39.1 |
| CYCLE 5 | 21 | — | 4.0 | 7.0 | 8.6 | 10.0 | 33.5 | 23.9 |
| CYCLE 6 | 22 | — | 6.5 | 9.0 | 10.0 | 11.5 | 42.5 | 23.0 |
| | | 10 | 20 | 30 | 40 | 50 | | |
| SYSTEM 23 | | | | | | | | |
| CYCLE 1 | 8 | 1.1 | 9.2 | 12.8 | 14.1 | 18.2 | 27.6 | 23.0 |
| CYCLE 2 | 11 | — | 1.4 | 7.2 | 10.7 | 14.4 | 37.7 | 30.9 |
| CYCLE 3 | 3 | | | | NOT DETERMINED | | | |
| CYCLE 4 | 0 | | | | NOT DETERMINED | | | |

It is apparent from the data in this example that, if the residual moisture content of the used sand is too high (system 23) then on repeated recycling a bench life of at least 80% of the original cannot be maintained at the end of each cycle.

We claim:

1. A method of producing an acceptable reclaimed sand from foundry moulds or cores which have been used to produce metal castings which method comprises comminuting to particulate form, used molds or cores formed from a composition consisting essentially of particulate sand, aqueous sodium silicate and an alkylene carbonate, with the content of alkylene carbonate not exceeding 11% by weight based on the weight of aqueous sodium silicate and subjecting the resultant particles to an attrition process so as to remove contaminants therefrom and wherein prior to or during the attrition process the particles are dried so that they contain no more than 0.8% by weight of residual moisture as determined by loss or ignition at 550° C.

2. The method according to claim 1 wherein during reclamation the used sand composition contains no more than 0.5% by weight of residual moisture as determined by loss on ignition of 550° C.

3. The method according to claim 1 wherein the alkylene carbonate content is 8–11% by weight based on the weight of aqueous sodium silicate.

4. The method according to claim 1 wherein the alkylene carbonate is selected from the group consisting of propylene carbonate, an isomer of butylene carbonate and a mixture of ethylene carbonate and propylene carbonate.

5. The method according to claim 1 wherein sodium silicate has a silica to soda molar ratio of from 2.0:1 to 2.7:1.

* * * * *